United States Patent [19]

Frye et al.

[11] Patent Number: 4,966,521

[45] Date of Patent: Oct. 30, 1990

[54] TAIL STOPPING AND KNOCKDOWN DEVICE

[75] Inventors: Kenneth G. Frye, South Egremont, Mass.; Donald C. Fitzpatrick, Chatham, N.Y.; Donald R. Grody, Pittsfield, Mass.

[73] Assignee: Beloit Corporation, Beloit, Wis.

[21] Appl. No.: 888,083

[22] Filed: Jul. 16, 1986

Related U.S. Application Data

[63] Continuation of Ser. No. 557,439, Dec. 2, 1983, abandoned.

[51] Int. Cl.[5] ..... B65G 60/00

[52] U.S. Cl. ..... 414/788.8; 414/794.4; 414/794.5; 414/792.7; 414/793; 414/796.1; 414/797.9; 414/786; 271/3.1; 271/182; 271/183; 271/202; 271/218

[58] Field of Search ..... 414/29, 37, 72, 73, 414/90, 115, 130, 91, 131, 125, 786, 788, 788.1, 788.8, 788.9, 790.6, 790.8, 792.7, 794.4, 793, 794.5, 793.1, 796.1, 797.9; 271/3.1, 183, 182, 202, 218

[56] References Cited

U.S. PATENT DOCUMENTS

| | | | |
|---|---|---|---|
| 1,545,914 | 7/1925 | Maxson | 271/202 |
| 1,767,907 | 6/1930 | Werotte | 198/780 X |
| 2,177,460 | 10/1939 | Renz | 271/202 X |
| 2,641,321 | 6/1953 | Cruzan | 414/115 X |
| 2,940,617 | 6/1960 | Reed | 414/114 |
| 3,432,161 | 3/1969 | Dale et al. | 271/183 |
| 4,162,649 | 7/1979 | Thornton | 271/218 X |
| 4,247,094 | 1/1981 | Vits | 271/183 |
| 4,396,336 | 8/1983 | Malamood | 414/115 |

FOREIGN PATENT DOCUMENTS

| | | | |
|---|---|---|---|
| 27151 | 1/1955 | Finland | 414/115 |
| 0089158 | 7/1980 | Japan | 414/114 |
| 202695 | 3/1966 | Sweden | 414/114 |
| 932004 | 7/1963 | United Kingdom | 271/183 |
| 1580056 | 11/1980 | United Kingdom | 271/202 |

*Primary Examiner*—Frank E. Werner

*Attorney, Agent, or Firm*—Dirk J. Veneman; Raymond W. Campbell

[57] ABSTRACT

A device for slowing cut sheets in seriatum flow by nipping the trailing edge of the sheets as they leave a high-speed conveyor system is provided whereby the sheets pass to a stacking pile at a slow speed. The nipping device is provided in several embodiments including a brush carrying roll, an oscillating roll on a lever arm and an air jet. Ream removal apparatus are also provided to remove reams of paper from the bottom of the stacking pile.

19 Claims, 2 Drawing Sheets

TAIL STOPPING AND KNOCKDOWN DEVICE

This is a continuation of co-pending application Ser. No. 557,439 filed on Dec. 2, 1983, now abandoned.

BACKGROUND OF THE INVENTION

1. Field of the Invention

The invention is directed to machinery for slowing down cut sheets of paper as they are fed to a stacking station and removal of reams from the stacking station and , more particularly, relates to a slowdown mechanism avoiding conventional overlap and in which more than one ream is collected in a pile prior to removal of the reams.

2. The Prior Art

In the paper-cutting machinery field, it is common for cut sheets to be overlapped or shingled enroute to a stacking or collection station. A problem in high-speed sheeting is to be able to slowdown the sheet sufficiently enough, so as to not have lead edge damage. To do so one necessitates overlapping the sheets where, again, as one goes up in speed, a limit is reached when the overlap approaches 100% and the maximum overlap speed reaches 250–350 fpm. High speed also causes a problem of air in the stacking pile and jog, making handling of the reams difficult and high quality hard to achieve.

The overlapping or shingling operation is usually performed by high and low-speed tape systems. The speed of the leading sheet is reduced as it is fed to the low-speed tape by some suitable means, such as a stop roll. One example of this stop roll shingling process is illustrated in U.S. Pat. No. 3,554,534, where a snap-down roll is also disposed upstream of the stop roll to defect the tail ends of sheets passing into the low-speed tape down and out of the way of the next oncoming sheet being delivered by the high-speed tape system.

SUMMARY OF THE INVENTION

In this invention, the conventional overlap is eliminated. Instead of stopping the sheet with the lead edge, a tail-stopping device, consisting in a first embodiment of a top brush roll which knocks the tail down, allowing the next sheet to cross over and overlap. The brush roll contacts the sheet near the tail, forcing it down against a roll going 250–350 fpm. As the brush leaves the roll, there is nothing to drive the sheet into the stacking pile, so it sits on the roll until the brush comes around again, knocking the tail down of the next sheet. The brush then puts pressure on both sheets. The bottom sheet is then accelerated to a 150–250 fpm speed into the stacking pile, while the top sheet then sits on the unnipped, slow-speed roll waiting for the next nip.

In accordance with a second embodiment, a stationary air blowdown is positioned above a slow-speed rotating vacuum roll which catches the tail of the sheet. In a third embodiment, the tail of the sheet is forced down against the bottom roll by an oscillating spring-loaded nip wheel which is actuated by a signal which determines location of the sheet edge and gap in order to maintain its proper position on a trailing edge of the sheet.

With the second and third embodiments of the invention, the device includes a rubber-covered or high-frictioned bottom vacuum or plain nip roll which is turning at a speed of 250–350 fpm. The fact that this roll is turning not only slows down the sheet when it is nipped against this roll, but also precludes the common problem of sheets hanging up in this area and not getting into the pile.

More than one ream is collected in this stacking, which accomplishes the compaction needed to compress all the air out of the pile. The reams are removed from the bottom of the pile by inserting a ream splitter spear type of device, whereby at a certain ream thickness, the spears (with a belt on them) are inserted into the pile. Attached to the spears is a pusher which will push the finished reams from two free-wheeling, lift-mounted conveyors onto an air table for conveying from the machine. In an alternate embodiment of the invention, the stacker and air table may be disposed at an incline.

DESCRIPTION OF THE PREFERRED EMBODIMENTS

Figure 1:
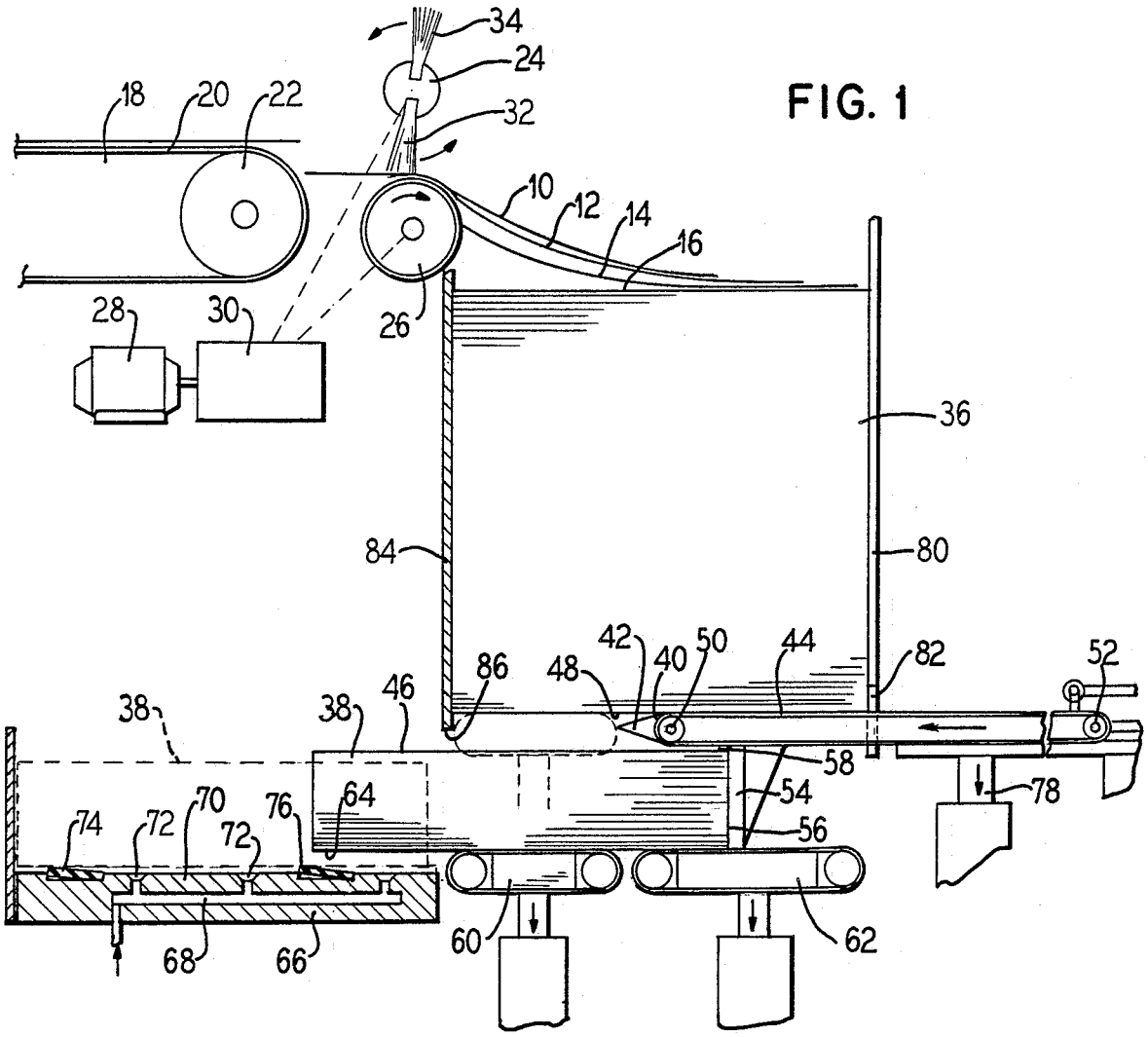
FIG. 1 is a schematic side elevational view illustrating the slowdown device and ream removal device of the present invention.

With reference to FIG. 1, there is illustrated a series of sheets, such as paper sheets 10, 12, 14 and 16 which have been cut by a knife into individual sheets upstream of FIG. 1 and are being passed in a seriatim flow. A high-speed tape conveyor system 18 having a tape means 20 supported at one end by a roll 22 and at the other end by a similar roll not shown, serves to convey the cut sheets at high speed. The high-speed tape 20 conveys the sheets at speeds of up to 1500 feet per minute.

Immediately downstream of the turnaround roll 22, there is provided a slowdown device in accordance with the principles of the present invention. In the embodiment shown in FIG. 1, there is provided a tail-stopping device which comprises a top brush roll 24 and a slowly rotating roll 26. Both rolls 24 and 26 are operated by means of an electric motor 28 operating through appropriate gearing means 30.

The slow rotating roll 26 rotates with a surface speed of approximately 250–350 fpm. The brush roll has two radially extending brush members 32, 34 which are diametrically opposed on the roll 24. As sheets are fed by the conveyor system 18, the lead edge of the sheets passes between the two rolls 24, 26 when the brush members 32, 34 are disposed approximately horizontally such that the lead edge can pass between the two rolls. As the sheet continues to pass between the two rolls, one of the brush members comes in contact with a portion of the sheet near the tail end and forces the sheet downwardly against the slowly rotating roll 26. As the brush member, which continues to rotate, leaves the roll 26, there is nothing to drive the sheet into the stacking pile, so it sits there until the brush comes around again, knocking the tail down of the next sheet. As that occurs, the brush member puts pressure on both sheets. In FIG.

1 it is seen that the brush member 32 is knocking down the tail end of sheet 10 while sheet 12 is still engaged with the slowdown roll 26. With the brush member putting pressure on both sheets, the bottom sheet 12 is accelerated to a speed of appproximately 150–250 fpm into the stacking pile as is shown by sheet 14. The top sheet 10 continues to sit on the unnipped-slow-speed roll 26, waiting for the next nip of the brush member. In this manner, delivery into the stacking pile at slow speed is accomplished.

More than one ream of paper sheets is collected in the stacking pile 36, which accomplishes the compaction needed to compress all of the air out of the pile. The reams are removed from the bottom of the pile as seen in FIG. 1 where a ream 38 is being removed. A ream splitter spear 40 having a sharp pointed leading edge 42 for original entry into the stacking pile 36 and having a belt 44 on the spear is inserted into the stacking pile 36. The pointed leading edge separates a top sheet 46 of the ream 38 from a bottom sheet 48 of the stacking pile 36. The belt 44 on the spear 40 is supported at one end by a front roller 50 and at a second end by a rear roller 52. As the spear is inserted into the stacking pile 36 separating the ream 38 from the rest of the pile, the belt 44 moves on the rolls 50, 52 in a clockwise direction as viewed in FIG. 1 such that any portion of the belt 44 coming into contact with the bottom sheet 48 of the stacking pile 36 remains stationary with respect thereto until the spear is completely inserted into the stacking pile.

Depending downwardly from the spear 40 is a pusher plate 54 which engages a side-face 56 of the ream 38 and serves to move it laterally as the spear 40 is inserted into the stacking pile 36. The pusher plate 54 has a height at least slightly higher than the thickness of the ream 38 being separated in order to provide clearance as seen at 58 between the top sheet 46 of the removed ream 38 and the belt 44 which is moving around rollers 50 and 52.

The stacking pile 36 is normally supported by a lift table comprising two free wheeling conveyors 60, 62 which engage a bottom sheet 64 of the bottom ream in the stacking pile 36. The two conveyors 60, 62 comprise a split lift table which allows the reams to be supported while the spear 40 is being inserted and withdrawn. The two conveyors 60, 62 are mounted for independent vertical movement such that the ream and stacking pile 36 are continuously supported as required.

As the spear is inserted into the stacking pile 36 the pusher plate 54 moves the ream 38 which is supported on the free-wheeling conveyors 60, 62 toward an air table 66. When the ream 38 is deposited on the air table 66 as is shown in phantom, most of the weight of the paper is supported by an air cushion from air supplied under pressure through conduits 68 in the air table which are exposed to a top surface 70 of the table through individual air ports 72. Longitudinal conveyor belts 74, 76 which extend above the surface 70 of the air table 66 are used to move the individual reams to the next station in the paper processing system.

As the spear is retracted from the stacking pile 36, the smaller free-wheeling conveyor 60 moves vertically to support the bottom of the stacking pile while the spear continues to be withdrawn. As soon as the spear is withdrawn, the second conveyor 62 moves vertically to also support the stacking pile.

It is desired that the top sheet, represented by sheet 16 in FIG. 1, of the stacking pile remain at the same level relative to the rolls 26, 24 throughout the entire stacking operation. Therefore, the spear 40, as well as the free-wheeling rollers 60, 62 is mounted for vertical movement on a shaft 78. Also, as seen in FIG. 1, a housing 80 for the stacking pile 36 has a portion cut away at 82 corresponding to the entry point of the spear 40 such that the spear is able to engage the stacking pile 36 while the pile is still held within the housing 80 and as the spear moves into the stacking pile 36 it will also move downwardly due to the additional sheets being stacked on the pile such that when it reaches an opposite wall 84 of the housing 80 it will pass beneath a lower edge 86 of that wall.

Figure 2:
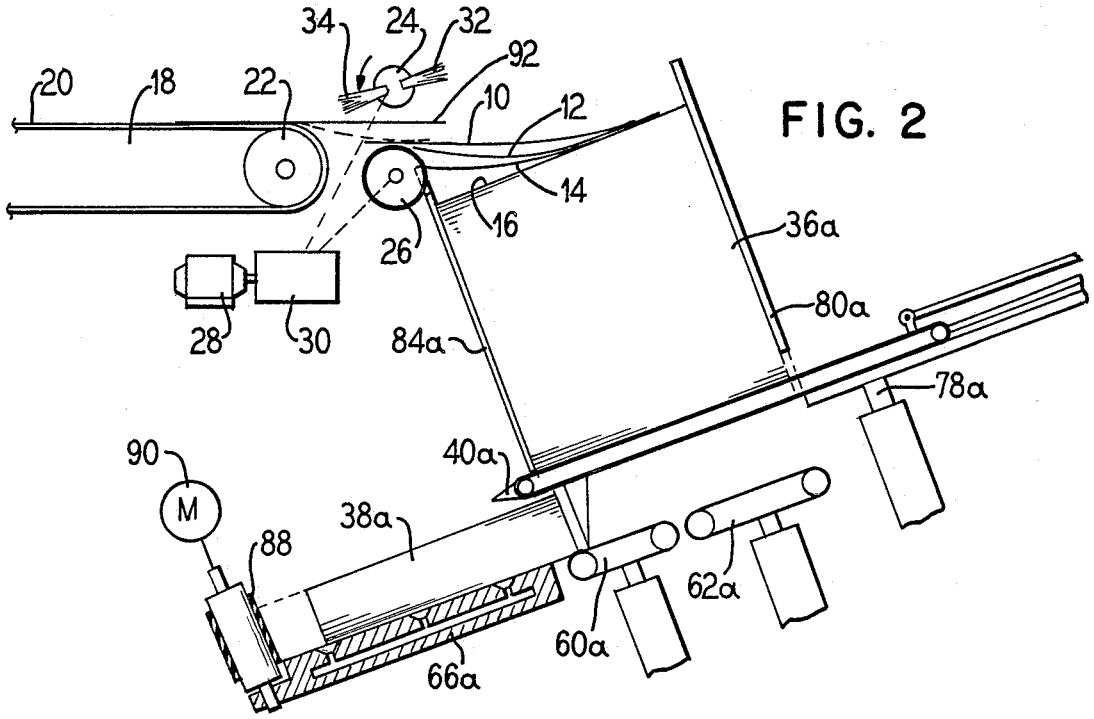
FIG. 2 is a schematic side elevational view illustrating an alternative embodiment of the present invention.

In FIG. 2 there shown an alternative embodiment of the ream separating arrangement in which the stacking pile 36*a*, the spear mechanism 40*a*, the free-wheeling conveyor 60*a* and 62*a* and the air table 66*a* all inclined to the same degree which allows for an enhancement of the stacking and separating procedure. The air table 66*a* has a side conveyor belt 88 associated therewith driven by motor 90 which moves the separated reams 38*a* to the next processing station as opposed to the bottom conveyor belt 74 and 76 of the embodiment shown in FIG. 1. In all other respects, the operation of this embodiment is the same as that shown in FIG. 1, this embodiment merely utilizes the force of gravity in assisting in the alignment of the stacking pile 36*a* and in the removal of the separated reams 38*a*.

FIG. 2 does show the brush roller 24 in a different rotational position than that shown in FIG. 1 and it is seen that a sheet of paper 92 is being passed between the rollers 24, 26 by means of the high-speed tape mechanism 18. It is also seen that brush member 34 will contact the tail end of sheet 92 causing it to drop down against roll 26 where the pressure of the brush member 34 will cause the sheet 10 lying on the roll 26 to accelerate and move into the stacking pile 36*a*.

Figure 3:
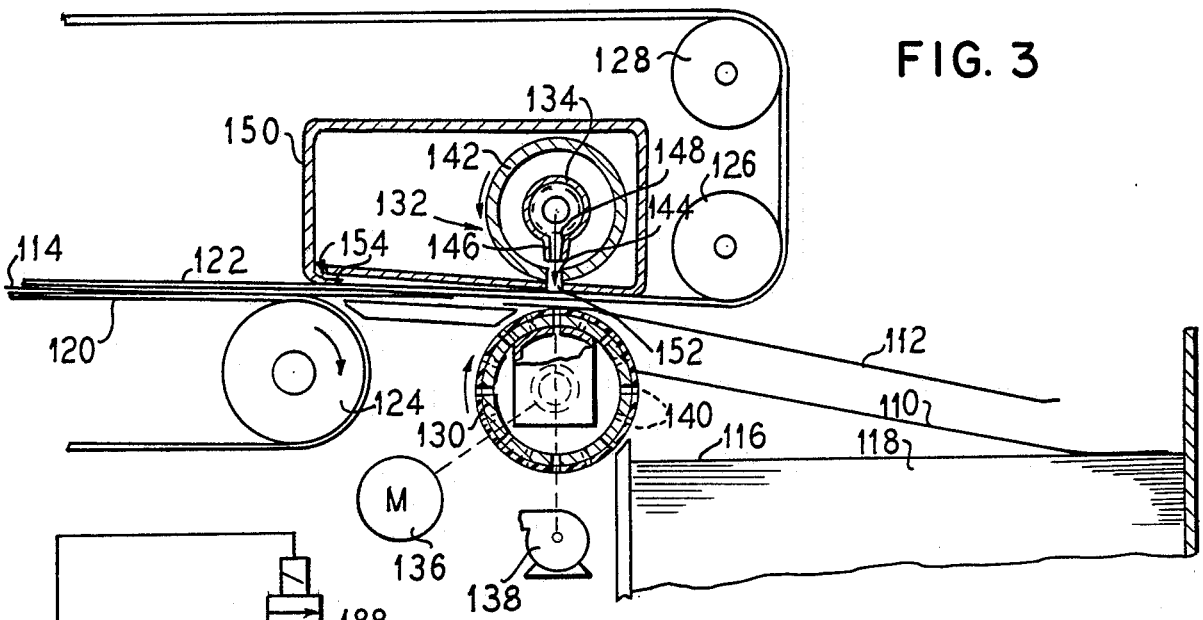
FIG. 3 is a partial schematic side elevational view illustrating a second embodiment of the slowdown device of the present invention.

FIG. 3 shows an alternative embodiment of the tail stopping and knockdown device of the present invention where it is seen that individual sheets 110, 112, 114 and 116 are fed into a stacking pile 118 by means of two high-speed tapes 120, 122 which convey the sheets at speed up to 1500 fpm. The lower tape means 120 is supported at one end by roll 124 and at an opposite end by a similar roll not shown and the upper tape means 122 is supported by rolls 126, 128 and by additional rolls not shown. The upper tape 122 extends further rightward in FIG. 3 of the turnaround roll 124 of the bottom tape 120.

Downstream of the turnaround roll 124, there is provided an alternative embodiment of the slowdown device of the present invention. In the embodiment shown in FIG. 3, there is provided a tail-stopping device which comprises slowly rotating vacuum roll 130 and a blow down device indicated generally at 132. The vacuum roll 130 is rotated by means of an electric motor 136. A blower shown schematically at 138 is used to evacuate the vacuum roll 130 and to pressurize the hollow interior of an air nozzle 134.

The vacuum roll 130 has a series of openings 140 therethrough and is generally hollow, the blower 138 being arranged to evacuate the hollow interior thereby causing air to be drawn radially inwardly in the openings 140. Because of the large number openings 140 in the roll 130, the suction pressure at any one given opening 140 is relatively low.

The blow down device 132 comprises a generally cylindrical rotating housing 142, disposed horizontally, which has a longitudinal slot 144 extending along its length which is disposed at the lowest portion of the housing 142. The housing 142 surrounds the nozzle 134 which comprises a generally hollow member having an elongated nozzle element 146 which has a central passageway 148 extending radially outwardly in the nozzle member. The housing 142 is drivingly rotated by the motor 136 about its horizontal axis such that the nozzle passage 148 will align with the slot opening 144 in the housing 142 once during each revolution of the housing 142.

The rotating housing 142 is in turn enclosed within an air box 150 which has a slot 152 therein which can align with the rotating slot 144 of the rotating housing 142. Once during each revolution of the housing 142 the slots 144 and 152 will align and an air blast will exit downwardly between the tape means 122 and against a tail end of a sheet of paper, thereby forcing the sheet against the slowdown roll 130. As the rotating housing 142 rotates, it shuts off the air to slot 152 as the lead edge of the next sheet of paper passes through that position.

A second, horizontally disposed slot 154 is provided in the air box 150 upstream of the first slot 152 which directs air in the direction of the movement and which causes a venturi action between the paper and the air box 150, thereby holding the lead edge of the paper against the top tapes 122. In this manner, the lead edge of the following sheet is lifted over the trailing edge of the preceding sheet which is overlying the stacking pile 118.

Figure 4:
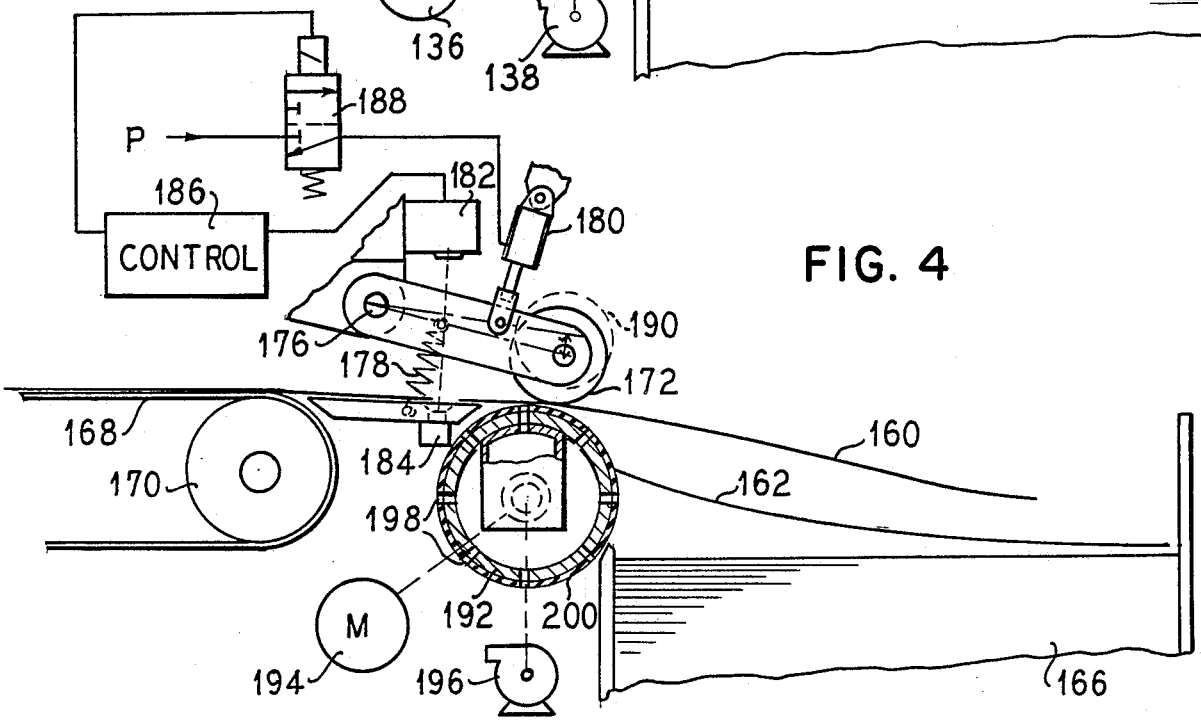
FIG. 4 is a partial schematic side elevational view illustrating a third embodiment of the slowdown device of the present invention.

FIG. 4 shows an alternative embodiment of the tail stopping and knockdown device of the present invention where it is seen that individual sheets 160, 162 and 164 are fed into a stacking pile 166 by means of a high-speed tape means 168 which conveys the sheets at speeds up to 1500 fpm. Tape means 168 is supported at one end by turnaround roll 170 and at an opposite end by a similar roll not shown.

Immediately downstream of the turnaround roll 170, there is provided a second alternate embodiment of a slowdown device constructed in accordance with the principals of the present invention. In the embodiment shown in FIG. 4, there is provided a tail-stopping device which comprises an oscillating spring-loaded nip wheel 172 which is actuated accurately by a signal which determines the location of the sheet edge and gap in order to maintain its proper position on the trailing edge of the sheet.

The nip wheel 172 is rotatingly carried on the end of an arm 174 which pivots about a fixed point 176. The arm 174 is continuously biased downwardly by spring means 178 and it is selectively urged upwardly by actuating means 180 such as a retracting piston.

A sheet location sensing means 180 is shown in FIG. 4 in the form of an optical sensor having a light emitting or reflecting means 184 which causes light to be directed at the sensor 182 during the gap between succeeding sheets of paper. The sensor 182 is connected to a control means 186 which controls a valve means 188 connected to the piston 180. At appropriate times the piston 180 is caused to be retracted thereby lifting the nip wheel 172 to the position shown in phantom at 190. This allows the sheet to travel past the nip wheel. Just prior to the tail of the sheet passing the nip wheel 172, the control means 186 causes the lifting means 182 release and the bias of the spring 178 causes the nip wheel 172 to move downwardly to press the tail of the sheet against a slowly rotating roll 192. In this manner, the sheet is slowed and is caused to drop into the stacking pile 166.

The slowly rotating roll 192 is rotated by a motor means 194 and it can be of a vacuum roll type with an interior evacuated by a blower means 196 and having a plurality of spaced openings 198 therethrough. An outer surface 200 of the roll 192 is rubber-covered or is of a high-frictioned material which assists the vacuum roll in gripping the sheets.

Figure 5:
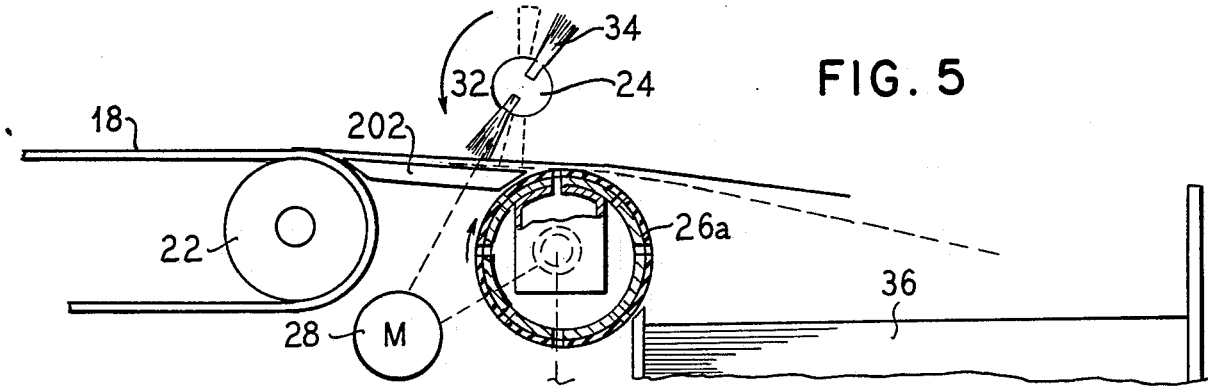
FIG. 5 is a partial schematic side elevational view illustrating a fourth embodiment of the slowdown device of the present invention.

FIG. 5 shows an alternative embodiment of the tail-stopping device shown in FIG. 1 which includes a plate 202 dispose immediately downstream of the turnaround roll 22 and just upstream of a slowly rotating roll **26*a* which is shown to be a vacuum roll. In this embodiment each sheet is slowed down and passed to the stacking pile 36 individually and immediately rather than sitting on the unnipped-slow-speed roll 26 of FIG. 1, waiting for the next nip of the brush member 32**.

As it appears from the foregoing specification, the invention is susceptible of being embodied with various alterations and modification which may differ particularly from those that have been described in the preceding specification and description. It should be understood that we wish to embody within the scope of the patent warranted hereon all such modifications as reasonably and properly come within the scope of our contribution to the art.

I claim as my invention:

1. An apparatus for slowing and collecting in stacks sheets delivered in seriatum flow from a sheet carrying surface of a high speed conveyor, said apparatus comprising:

a slowdown roll assembly for receiving the sheets from the high speed conveyor, including a continuously rotating roll and a drive means for rotating said roll at a substantially constant speed slower than the high speed conveyor system, said roll having a sheet engaging surface for advancing sheets nipped there against while allowing said roll to rotate freely beneath sheets resting unnipped thereon without advancing the resting sheets;

a combination tail knockdown and nipping means operating intermittently for depressing the tail ends of sheets leaving the high speed conveyor and for periodically forming a nip with said rotating roll for advancing sheets nipped to said continuously rotating roll, said knockdown and nipping means being controlled to allow the leading edge of a sheet to pass unrestricted over the depressed tail of a sheet immediately preceding it;

a collection unit adjacent said slowdown roll assembly including upstream and downstream walls defining a stack collecting area for receiving sheets advanced by said slowdown roll assembly directly from said slowdown roll assembly; and ream removing means for automatically and continuously removing reams of sheets from the bottom of the pile formed in said collection unit, said removing means including a spear means for separating a ream from the pile, pusher means for urging a separated ream from the pile, movable support means for supporting the bottom of the stacking pile and conveyor means for transporting the separated ream to a distant point.

2. The apparatus of claim 1 wherein said slowdown roll assembly has a sheet engaging surface disposed at a level below said sheet carrying surface of said conveyor system.

3. The apparatus of claim 1 whereby said nip means comprises a rotating brush roll spaced from said roll means and having at least one brush means extending radially therefrom of a length sufficient to reach said roll means.

4. The apparatus of claim 3 wherein said brush roll and said slowdown roll means rotate in opposite directions.

5. The apparatus of claim 1 wherein said walls are disposed substantially vertical.

6. The apparatus of claim 1 wherein said walls are disposed at an angle to vertical wherein the bottoms of said walls are farther upstream than the top of said walls.

7. The apparatus of claim 1 wherein said spear means includes a free rotating belt means for engagement with a bottom sheet on said stacking pile above said removed ream.

8. The apparatus of claim 1 wherein said pusher means comprises a plate depending downwardly from said spear means.

9. The apparatus of claim 1 wherein said movable support means comprises a plurality of free rolling conveyors independently movable toward said stacking pile for support thereof and away from said stacking pile during removal of said reams and for clearance with said pusher means.

10. The apparatus of claim 1 wherein said conveyor means comprises a table member for supporting said removed ream and moving belt means for engaging said ream and moving it to said distant point.

11. The apparatus of claim 10 wherein said table member comprises an air table having air jets supporting a portion of the weight of said ream.

12. The apparatus of claim 10 wherein said table has a substantially horizontal surface and said moving belt means is substantially parallel with said surface.

13. The apparatus of claim 10 wherein said table has a surface disposed at an angle to horizontal and said moving belt means is substantially perpendicular to said surface.

14. The apparatus of claim 1 wherein said spear means, said pusher means and said movable support means are each vertically movable such that a top sheet on said stacking pile is kept substantially at the same level throughout the stacking operation.

15. A tail stopping and knockdown apparatus for use in conveying sheets between a high speed conveyor and a stacker, said tail stopping and knockdown apparatus comprising:

a slow down roll means disposed adjacent the stacker and below sheets leaving the high speed conveyor for advancing such sheets at reduced speed directly into the stacker;

said slow down roll means including a sheet engaging surface for advancing sheets nipped thereagainst while freely rotating beneath sheets resting unnipped thereon without advancing non-nipped sheets;

drive means for rotating said slowdown roll means continuously and at a speed slower than the speed of the high speed conveyor; and a combination knockdown and nipping means for physically depressing the tail end of a sheet below the leading edge of the immediately following sheet, thereby allowing the leading end of the immediately following sheet to advance over the tail end of the depressed sheet, and for intermittently forming a nip with said slow down roll means, thereby placing the tail end of the depressed sheet and the leading end of the immediately following sheet into driving engagement with said slowdown roll means, said combination knockdown and nipping means having a non-nipping relationship to said slow down roll means after the tail end of the depressed sheet is advanced off said slow down roll means, allowing the partially advanced immediately following sheet to rest unnipped on said slow down roll means without advancing thereover until again nipped thereto.

16. The apparatus of claim 15 whereby said nip means comprises a rotating brush roll spaced from said roll means and having at least one brush means extending radially therefrom of a length sufficient to reach said roll means.

17. An apparatus as defined in claim 15 wherein said combination knockdown and nipping means comprises a rotating brush depressing the sheets and forming the nip with said slow down roll means.

18. A method for slowing sheets entering a stacker from a high speed conveyor, said method including:

providing a rotatable roll between and adjacent the high speed conveyor and the stacker;

rotating said roll continuously at a speed slower than the high speed conveyor;

passing sheets from the high speed conveyor over the rotating roll;

forcing the rail end of each sheet downwardly toward the rotating roll as the sheet passes over the rotating roll;

passing the leading edge of an immediately following sheet over the tail end of the sheet after the tail end has been forced downwardly;

causing each sheet to rest relatively stationarily on the rotating roll as the leading edge of the immediately following sheet passes thereover;

forcing the immediately following sheet downwardly against the sheet resting relatively stationarily on the rotating roll;

causing the lowermost of the then overlapped sheets to be driven from its resting position into the stacker by said rotating roll; and causing said immediately following sheet to assume the relatively stationary position previously occupied by said first mentioned sheet, thereby permitting a sheet immediately following said second mentioned sheet to advance thereover while said second mentioned sheet rests in nonadvancing position on the continuously rotating roll.

19. The method defined in claim 18 wherein said steps of forcing sheets downwardly are performed by rotating a roll above the first mentioned roll, providing the second mentioned roll with at least one brush extending therefrom and causing the brush to contact the sheets disposed therebelow.

* * * * *